United States Patent [19]

Meadows et al.

[11] 4,453,636

[45] Jun. 12, 1984

[54] SAFE CONTAINER

[76] Inventors: Bernard A. Meadows, Rte. 4, Box 153; Larry A. Meadows, Rte. 4, Box 50; Barbara A. Meadows, Rte. 4, Box 153, all of Elkton, Va. 22827

[21] Appl. No.: 491,855

[22] Filed: May 3, 1983

[51] Int. Cl.[3] ..... B65D 83/04; B65D 85/42

[52] U.S. Cl. ..... 206/534; 206/221; 206/459; 206/807; 215/366; 215/DIG. 8

[58] Field of Search ..... 206/459, 807, 221, 534; 215/366, DIG. 8

[56] References Cited

U.S. PATENT DOCUMENTS

| | | | |
|---|---|---|---|
| 2,533,806 | 12/1950 | Holzapfel | 206/221 |
| 2,764,157 | 9/1956 | Oliva et al. | 206/221 |
| 2,787,268 | 4/1957 | Greenspan | 206/221 |
| 2,793,776 | 5/1957 | Lipari | 206/221 |
| 2,813,649 | 11/1957 | Lipari | 206/221 |
| 3,321,097 | 5/1967 | Solowey | 206/221 |

*Primary Examiner*—Joseph Man-Fu Moy

*Attorney, Agent, or Firm*—Mason, Fenwick & Lawrence

[57] ABSTRACT

A medicine bottle is formed of transparent plastic including a cylindrical container, a peripheral wall, a bottom wall, and an intermediate wall positioned above the bottom wall to define an inaccessible view chamber. A removable cap assembly is mounted on the upper end extent of the peripheral wall and an elongated rod has one end fixedly connected to the removable cap and has an opposite end extending through the intermediate wall and terminating in the view chamber. An indicator disc is threaded on the end of the elongated rod and becomes disconnected from the elongated rod in response to rotation of the rod caused by opening rotation of the cap to provide a subsequent indication of prior removal of the cap from the container.

16 Claims, 8 Drawing Figures

SAFE CONTAINER

BACKGROUND OF THE INVENTION

The present invention is in the field of containers and is more specifically directed, in its preferred embodiment, to a medicine bottle type container. Even more specifically, the present invention is directed to a unique medicine bottle which provides a visible indication of any prior opening of the bottle.

A number of unfortunate recent events have suggested the need for a reliable, fool-proof, and inexpensive medicine container which will clearly indicate prior tampering with or opening of the container. U.S. Pat. Nos. 560,653; 565,194; 576,805; 597,767; 605,227; 715,104; 732,592; 1,072,139; and 1,156,360 have been noted as being of general interest with respect to container of this same general type.

SUMMARY OF THE INVENTION

Therefore, it is the primary object of the present invention to provide a new and improved container which will provide an indication of any prior opening of the container.

Achievement of the foregoing object is enabled by the preferred embodiment of the invention which comprises a cylindrical medicine bottle formed of transparent plastic and having an upper end on which a removable external cap is received. The cylindrical bottle includes a peripheral wall of cylindrical configuration, a bottom end wall, and an intermediate wall. A closed inaccessible space is defined between the bottom wall and the intermediate wall which comprises a view chamber in which an indicator means in the form of a disc is positioned. The disc includes a threaded axial aperture and also has inwardly extending radial slots provided on opposite sides and which receive downwardly extending protrusion lugs which extend downwardly from the intermediate wall to prevent rotation of the disc. An elongated threaded rod is connected at its upper end to the removable external cap fitted over the upper end of the container and extends downwardly through an axial opening provided in the intermediate wall so as to have its lower end positioned in the view chamber. The disc is threaded on the threads provided on the lower end of the elongated rod and a compression spring is provided between the disc and the lower face of the intermediate wall so that upon rotation of the cap, the lower end of the rod becomes unthreaded from the disc which is hurled downwardly to the lower portion of the view chamber by action of the compression spring. The cap can then be removed to provide access to the bottle contents. The compression spring is attached to one face of the disc and is of such a length as to preclude the disc from again being positioned to engage the metal rod to permit reconnection of the rod to the disc. Thus, the fact that the disc has been disconnected from the rod is readily apparent to any user so as to indicate that the removable cap has been previously removed from the bottle and reconnection of the disc to the rod is impossible.

A better understanding of the preferred embodiment of the invention will be achieved when the following detailed description is considered in conjunction with the appended drawings in which like reference numerals are used for the same parts as illustrated in the different figures of the drawings.

DESCRIPTION OF THE PREFERRED EMBODIMENT

Figure 1:
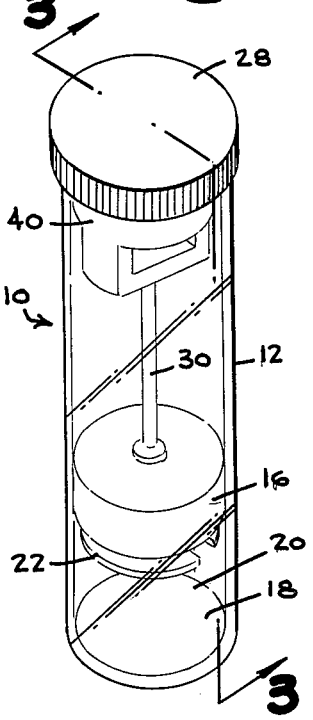
FIG. 1 is a perspective view of the preferred embodiment of the invention illustrating its appearance prior to removal of the cover cap from the bottle.
Figure 4:
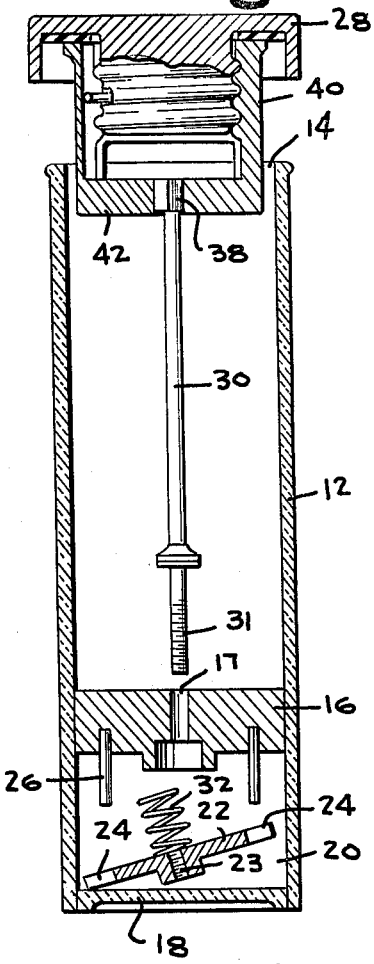
FIG. 4 is a bisecting sectional view similar to FIG. 3 but illustrating the parts in the condition assumed following removal of the cap.

Attention is initially invited to FIG. 1 of the drawings which illustrates the preferred embodiment, generally designated 10, and which comprises a medicine bottle container in the form of a peripheral wall 12 of cylindrical configuration and which is provided with an opening 14 at is upper end as shown in FIG. 4. An intermediate wall 16 having an axial opening 17 is provided within the peripheral wall 12 and is fixedly connected thereto by welding, bonding, or adhesive with a lower or bottom wall 18 being spaced from and fixedly positioned beneath the intermediate wall 16. The space between the intermediate wall 16, the bottom 18, and the portion of peripheral wall 12 therebetween comprises a view chamber 20 which can be easily inspected visually since the components 12, 16, and 18 are formed of transparent plastic or the like.

Indicator means in the form of a disc 22 is provided in the view chamber 20 with the disc having a threaded bore 23 (FIG. 4) and inwardly extending radial slots 24 provided on opposite sides. Slots 24 are fitted over first and second positioning lugs 26 which extend downwardly from and are fixedly connected in the intermediate wall 16.

Figure 6:
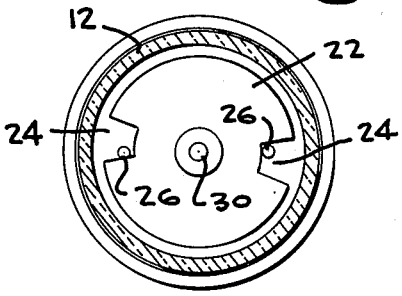
FIG. 6 is a sectional view taken along lines 6—6 of FIG. 3 and illustrating the parts in the position prior to removal of the removable cap.

A cap assembly 27 includes a cap 28 which is provided over the opening 14 of the peripheral wall 12 and includes a downwardly extending externally threaded cylindrical lug 29 which is threaded into a rod carrier sleeve 40 in the lower end of which the upper end 38 of an elongated metal rod 30 is fixedly positioned. The elongated metal rod 30 has a threaded lower end surface 31 which extends downwardly through the axial opening 17 extending through the intermediate wall 16. The lower threaded end portion 31 of the rod 30 is consequently positioned in the view chamber 20 and is threadably received in the threaded bore 23 of the indicator disc 22. A compression spring 32 is attached to the upper surface of the disc 22 and is positioned in a cylindrical protrusion 33 extending downwardly from the lower side of intermediate wall 16. Spring 32 is in a compressed condition when the device is in the assembled condition of FIGS. 1, 3, and 6.

Figure 5:
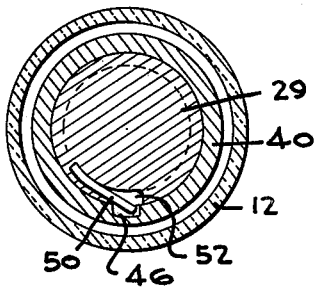
FIG. 5 is a sectional view taken along lines 5—5 of FIG. 3.
Figure 7:
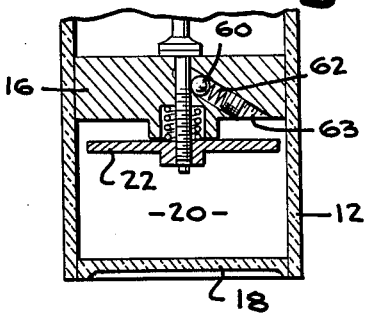
FIG. 7 is a sectional view taken along lines 7—7 of FIG. 3.

It should be observed that the upper end 38 of metal rod 30 is positioned in a horizontally extending bail portion 42 which is positioned downwardly below an upper cylindrical portion of the rod carrier sleeve. The upper cylindrical portion includes internal threads 44 and a drive slot 46 extending parallel to the axis of the rod carrier sleeve. An open space 48 above the bail 42 permits medication M or the like to be inserted in the bottle prior to the connection of the cap 28 to the rod carrier sleeve 40. The threaded cylindrical lug 29 includes a one-way drive pawl 50 positioned in a slot 52 and oriented as shown in FIG. 5. The orientation of the one-way drive pawl 50 is such that the cap 28 can be screwed downwardly by clockwise rotation of cap 28 with the drive pawl slipping over the drive slot 46. However, reverse counter-clockwise rotation of cap 28 results in engagement of the drive pawl 50 with the drive slot 46 so that the cap 28 cannot be removed from the rod carrier sleeve. The rod carrier sleeve is consequently rotated and will drivingly rotate the elongated metal rod 30 in response to counter-clockwise movement of the cap 28.

In use, the bottle is initially provided without bottom wall 18. The rod carrier sleeve 40 and the cap 28 are totally separated and the rod carrier sleeve 40 is positioned in the bottle with the threaded end 31 extending into the view chamber 20. Indicator disc 22 is positioned in contact with the lower end of the bottle and subsequent rotation of the rod carrier sleeve 40 effects connection of the threaded lower end of metal rod 30 to the threaded bore 23 of the indicator disc. The foregoing action also results in compression of spring 32. It will be observed that the positioning lugs 26 prevent rotation of the disc 22 during the threading connection of the disc to the lower end of rod 30. After the lower end of rod 30 is connected to disc 22 the medication M can be added to the bottle and the bottom wall 18 sealed in position. The cap 28 is then threaded downwardly into the rod carrier sleeve 40 to completely close the container and seal it by virtue of contact of a seal member 52 with the upper end of the peripheral wall 12.

Figure 8:
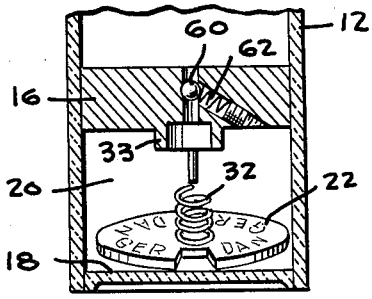
FIG. 8 is a sectional view similar to FIG. 6 but illustrating the position of the parts following removal of the cap.

The container can also be used with liquid contents by virtue of the inclusion of a circle valve member 60 which is urged into passageway 17 upon removal of rod 30, the consequence of the action of a small compression spring 62. However, the spherical valve member 60 can be forced back downwardly into the canted bore 63 in which it is positioned by reinsertion of the rod 30. FIG. 8 illustrates the positioning of the spherical valve following removal of rod 30 such as would occur upon counter-clockwise rotation of cap 28 which would result in driving engagement of the member 50 in the slot 46 to remove the cap 28 and the rod carrier sleeve 40 unitarily as a unit. Following such removal, the container would be closed by a conventional snap-on plastic cap which would fit over the upper end of the peripheral wall 12.

Figure 3:
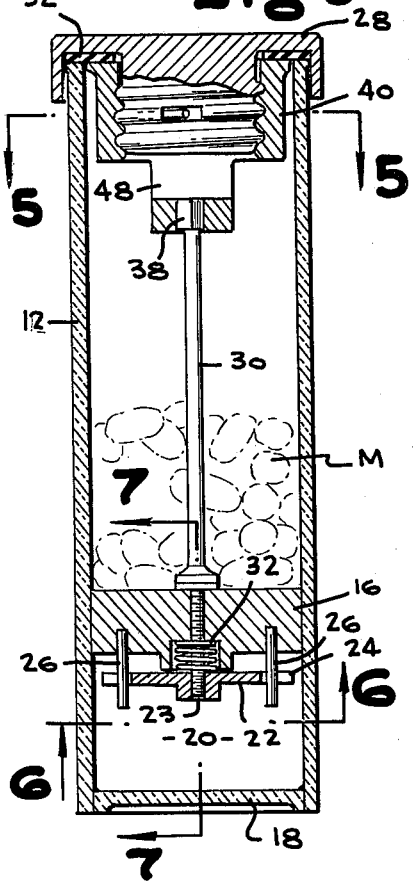
FIG. 3 is a bisecting sectional view of the preferred embodiment taken along lines 3—3 of FIG. 1.
Figure 2:
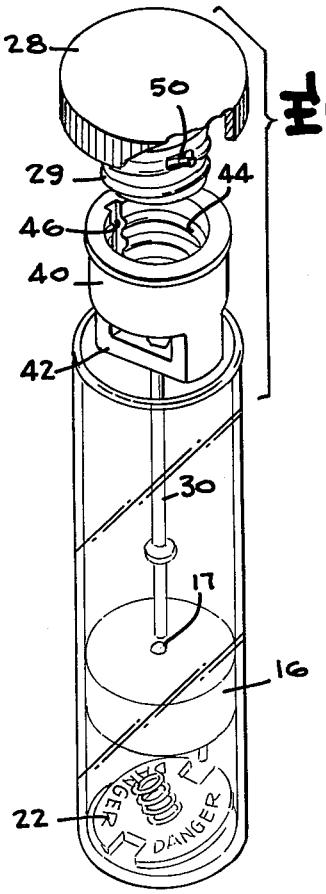
FIG. 2 is an exploded perspective view similar to FIG. 1 but illustrating the components.

When the preferred embodiment is in the assembled condition illustrated in FIGS. 1, etc., compression spring 32 is in its compressed condition and is positioned within the confines of the cylindrical protrusion 33 as best shown in FIG. 3. However, upon counter-clockwise rotation of the cap 28, rod 30 is also rotated so that its threaded lower end portion 31 becomes disengaged from the threaded bore 23 of the indicator disc 22 and compression spring 32 consequently hurls the disc 22 downwardly to the lower position in the view chamber 20 illustrated in FIG. 4. The positioning of the disc in the position illustrated in FIGS. 2, 4, and 8 is indicative of the fact that the cap 28 has been previously removed. Moreover, the disc can be provided with a legend such as "Danger" on its face so as to provide a clear warning to the user.

The length of compression spring 32 when in its uncompressed condition illustrated in FIG. 4 is greater than the length of the portion of rod 31 extending into the view chamber when the cap is in its closed position so that the compression spring effectively prevents reconnection of the rod 30 to the disc 22 once it has been disconnected. It should also be noted that the protruding lugs 26 prevent rotation of the disc during the initial removal of the cap 28 so as to ensure that the rod 30 becomes unthreaded from the disc.

It should be understood that the members 22, 30, and 40 are initially assembled prior to the positioning of the bottom wall 18 in the peripheral wall 12. The bottom wall 18 is then positioned as shown and is permanently secured in position by either adhesive or thermal welding.

Thus, it will be seen that the present invention provides a unique and fool-proof indication of any prior opening of the container so as to provide a full and complete protection for the public. While many modifications of the preferred embodiment will undoubtedly occur to those of skill in the art, it should be understood that the spirit and scope of the invention is to be limited solely by the appended claims.

I claim:

1. A storage assembly comprising:

a container including a peripheral wall, a bottom wall, and an intermediate wall positioned above said bottom wall to define an inaccessible view chamber bounded by a portion of said peripheral wall, said intermediate wall and said bottom wall at least one of which walls is transparent so as to make said view chamber visible;

a removable cap assembly mounted on the upper extent of said peripheral wall;

an elongated rod having one end connected to said removable cap and having an opposite end extending through said intermediate wall and terminating in said view chamber;

indicator means connected to said opposite end of said elongated rod; and means for disconnecting said indicator means from said elongated rod in response to rotation of said rod so as to provide a subsequent indication of prior removal of the removable cap from the container.

2. A storage assembly as recited in claim 1 wherein said indicator means comprises a threaded member threadably mounted on threads provided on said opposite end of said elongated rod and further including an external cap threadably positioned on said peripheral wall so as to enclose said removable cap.

3. A storage assembly as recited in claim 2 wherein said means for disconnecting said indicator means includes coil spring means positioned between said indicator means and said intermediate wall and said removable cap assembly includes an upper cap and a rod carrier sleeve connected thereto by one-way drive means.

4. A storage assembly as recited in claim 3 additionally including lug means extending from said intermediate wall and engageable with said threaded member for preventing rotation of said threaded member.

5. A storage assembly as recited in claim 4 wherein said peripheral wall is of cylindrical configuration and said elongated threaded rod extends axially thereof.

6. A storage assembly as recited in claim 5 wherein said elongated threaded rod extends through an axial opening in said intermediate wall when said cap is mounted on the upper extent of said peripheral wall.

7. A storage assembly as recited in claim 7 wherein said container is formed of transparent plastic.

8. A storage assembly as recited in claim 8 additionally including a downwardly protruding cylindrical lug positioned axially on the intermediate wall and wherein said coil spring is mounted in said cylindrical lug.

9. A storage assembly as recited in claim 1 wherein said indicator means comprises a disc threaded on the opposite end of said elongated rod and having inwardly extending radial slots on opposite sides; and further including protrusion lug means extending downwardly from said intermediate wall and positioned in said slots for precluding rotation of said disc.

10. A storage assembly as recited in claim 9 wherein said means for disconnecting said indicator means includes coil spring means positioned between said indicator means and said intermediate wall.

11. A storage assembly as recited in claim 10 wherein said peripheral wall is of cylindrical configuration and said elongated threaded rod extends axially thereof.

12. A storage assembly as recited in claim 11 wherein said elongated threaded rod extends through an axial opening in said intermediate wall when said removable cap is mounted on the upper extent of said peripheral wall.

13. A storage assembly as recited in claim 12 wherein said container is formed of transparent plastic.

14. A storage assembly as recited in claim 13 additionally including a downwardly protruding cylindrical lug positioned axially on the intermediate wall and wherein said coil spring is mounted in said cylindrical lug.

15. The invention of claim 9 wherein said means for disconnecting said indicator means comprises a coil spring attached to said disc and positioned in a compressed state between said disc and said intermediate wall and wherein said coil spring has a length when in its uncompressed relaxed condition which is greater than the length of the portion of the elongated rod positioned in the view chamber when the cap is threaded on the container.

16. A storage assembly as recited in claim 15 wherein said peripheral wall is of cylindrical configuration and said elongated threaded rod extends axially thereof.

* * * * *